US009181627B2

(12) United States Patent
Drollinger et al.

(10) Patent No.: US 9,181,627 B2
(45) Date of Patent: Nov. 10, 2015

(54) METHOD FOR COATING, POLE TUBE AND DEVICE FOR CARRYING OUT THE METHOD

(75) Inventors: Grischa Norman Drollinger, Steinfeld (DE); Marcel Sieme, Fuerstenfeldbruck (DE); Christian Maus, Krefeld (DE)

(73) Assignee: Robert Bosch GmbH, Stuttgart (DE)

( * ) Notice: Subject to any disclaimer, the term of this patent is extended or adjusted under 35 U.S.C. 154(b) by 433 days.

(21) Appl. No.: 13/425,655

(22) Filed: Mar. 21, 2012

(65) Prior Publication Data

US 2012/0244374 A1 Sep. 27, 2012

(30) Foreign Application Priority Data

Mar. 22, 2011 (DE) ..... 10 2011 014 605

(51) Int. Cl.

| | |
|---|---|
| ***C23C 28/00*** | (2006.01) |
| ***C25D 5/34*** | (2006.01) |
| ***C25D 5/12*** | (2006.01) |
| ***C25D 17/00*** | (2006.01) |
| ***C25D 17/06*** | (2006.01) |
| ***H01F 7/08*** | (2006.01) |
| ***C25D 5/36*** | (2006.01) |

(52) U.S. Cl.

CPC .. *C25D 5/12* (2013.01); *C25D 5/36* (2013.01); *C25D 17/005* (2013.01); *C25D 17/06* (2013.01); *H01F 7/081* (2013.01); *Y10T 428/1241* (2015.01)

(58) Field of Classification Search

CPC ..... C23C 28/02; C23C 28/025; C25D 7/04

USPC ..... 205/191, 210

See application file for complete search history.

(56) References Cited

U.S. PATENT DOCUMENTS

| | | | | | |
|---|---|---|---|---|---|
| 3,279,955 | A | * | 10/1966 | Miller et al. | 136/205 |
| 3,455,014 | A | * | 7/1969 | Beyer | 29/460 |
| 3,671,406 | A | * | 6/1972 | Mattia et al. | 205/114 |
| 3,728,783 | A | * | 4/1973 | Chartet | 228/207 |
| 4,474,651 | A | * | 10/1984 | Yauchi et al. | 285/329 |
| 5,307,288 | A | | 4/1994 | Haines | |
| 6,741,056 | B1 | | 5/2004 | Hall | |

FOREIGN PATENT DOCUMENTS

| | | | | | |
|---|---|---|---|---|---|
| DE | 199 52 800 | A1 | | 8/2000 | |
| DE | 10 2008 019 501 | A1 | | 10/2009 | |
| JP | 06002104 | A | * | 1/1994 | C23C 10/28 |
| JP | 2003193273 | A | * | 7/2003 | C23F 1/28 |
| WO | 2011/023810 | A1 | | 3/2011 | |

OTHER PUBLICATIONS

Lowenheim, "The Watts Bath", Electroplating (© no month, 1978), pp. 212-213.*

Pilous, "Structural Stability of Welded Joints Between Plain Ferritic Steel and Austenitic Steel at Operating Temperatures of About 400 deg.," Archiv fuer das Eisenhuettenwesen (no month, 1975), vol. 46, No. 9, pp. 595-596. Abstract Only.*

* cited by examiner

*Primary Examiner* — Edna Wong

(74) *Attorney, Agent, or Firm* — Maginot, Moore & Beck LLP

(57) ABSTRACT

A method for coating workpieces which consist of two different metallic materials includes providing the workpiece in a nickel strike electrolyte with a nickel layer as substrate before the application of a corrosion-resistant layer.

6 Claims, 4 Drawing Sheets

METHOD FOR COATING, POLE TUBE AND DEVICE FOR CARRYING OUT THE METHOD

This application claims priority under 35 U.S.C. §119 to German patent application no. DE 10 2011 014 605.9, filed Mar. 22, 2011 in Germany, the disclosure of which is incorporated herein by reference in its entirety.

BACKGROUND

The present disclosure relates to a method for coating a workpiece consisting of two different metallic materials, a pole tube having two pole tube sections consisting of different materials, and a device for carrying out the method.

Switching or proportional magnets of hydraulic magnetic valves usually have a pole tube with an armature space for accommodating a magnetic armature whose armature plunger penetrates a pole base via which it is possible to adjust a valve slide of the magnetic valve. Since the design of the pole tubes is known from the prior art, for example, from DE 199 52 800 A1, it will not be described in detail here.

The pole tube consists of a material mix, usually of rust-resistant and acid-resistant stainless steel and unalloyed steel, for example construction steel St35 or St37. In order to avoid corrosion of the regions of the pole tube which are not rust-resistant, it is customary to provide the latter with a galvanically applied zinc layer. This coating of the pole tube encounters problems in practice because of the different materials, since the latter behave in a fundamentally different fashion during the pretreatments (degreasing, activation etc.) normally carried out in galvanic processes. Thus, for example, it can happen during the pretreatment that the pole tube regions consisting of stainless steel are polarized differently to those regions which consist of construction steel—and said different polarization then leads to problems in the adhesion of the zinc layer applied later. These adhesion problems can then lead to flaking owing to spalling of the zinc layer in the region of the stainless steel. In order to avoid this, use is made of specifically tuned pretreatment methods which, on the one hand, require a substantial processing outlay and, on the other hand, cannot fully eliminate the adhesion problems outlined.

By contrast, it is the object of the disclosure to provide a method for coating a workpiece consisting of two different metallic materials, a pole tube having two pole tube sections consisting of two different materials, and a device for carrying out the method, by means of which method, pole tube and device an improved adhesion of a corrosion-resistant layer is ensured.

This object is achieved with regard to the method by described herein, with regard to the pole tube described herein and with regard to the device described herein.

SUMMARY

The method is basically applicable to all workpieces consisting of two different metallic materials that form a material interface in the surface region of the workpiece, the workpiece being intended to be provided with a corrosion-resistant layer. At least in the region of the material interface, before the application of the corrosion-resistant layer the workpiece is provided with an electrolytically applied metallic adhesive layer which forms a substrate for the corrosion-resistant layer.

This electrolytically applied adhesive layer is preferably applied overall. However, it can also suffice in principle to apply this adhesive layer only in the region of those workpiece sections which are executed from a material with poor adhesive properties (stainless steel), it likewise being intended to cover the material interface.

The pole tube is provided in an appropriate way with an electrolytically applied adhesive layer for the later corrosion-resistant layer.

The device for carrying out the method has a holder which dips into an interior of the workpiece, the holder having at least two, preferably resilient, clamping legs which bear diametrically against an inner circumferential wall, one clamping leg acting along a clamping line running in an approximately parallel fashion, and the other clamping leg acting diametrically in relation thereto in an approximately punctiform fashion on the inner circumferential wall. These clamping legs enable the workpiece, in particular the pole tube, to be positioned in the electrolytical bath in a relative position predetermined for the electroplating, it being possible to make the electrical contact via the clamping legs.

In a particularly preferred exemplary embodiment, the adhesive layer is formed by a nickel strike electrolyte. This method, known per se from the prior art, has the purpose of removing (activating) the natural oxide skin of the rust-resistant and acid-resistant steel, and simultaneously producing a thin layer as substrate for the subsequent electroplating. It has been shown surprisingly that the problems described at the beginning can be virtually completely eliminated by such a nickel strike electrolyte so that spalling of the corrosion-resistant layer can be avoided even given unfavorable operating conditions.

In one exemplary embodiment of the disclosure, the surface of the workpiece is pickled before the formation of the adhesive layer, it being possible to insert a degreasing step before the pickling.

The adhesion of the corrosion layer can be further improved when such a pickling step is also carried out after the formation of the adhesive layer. Of course, the individual steps of the pretreatment are respectively followed by the rinsing operations that are customary in electroplating processes and are preferably carried out in several stages or as a rinsing cascade.

The corrosion-resistant layer is preferably a zinc layer.

The clamping legs of the holder for fixing the position of the workpiece inside the electrolyte are preferably formed symmetrically in paired fashion so that the workpiece is clamped and/or contacted from the inner circumference and from the outer circumference.

BRIEF DESCRIPTION OF THE DRAWINGS

A preferred exemplary embodiment of the disclosure is explained in more detail with the aid of diagrammatic drawings, in which.

DETAILED DESCRIPTION

The disclosure is explained below with reference to the electroplating of a pole tube. In principle, the method and the device can also be used to apply a corrosion-resistant layer to other components which are fabricated from different metallic materials.

The principle of the design of a pole tube is known from the prior art, for example from the publication named at the beginning, and so explanations touching on this are superfluous. The only substantial consideration for the following description of the disclosure is that the pole tube has regions consisting of corrosion-resistant stainless steel and regions made from conventional construction steel, which can lead to adhesion problems in the corrosion-resistant layer during later use of the pole tube when conventional electroplating is applied.

A multiplicity of pole tubes 1 are held on a frame 2 in the case of the method steps, described below, of the electroplating process for the purpose of applying a corrosion-resistant layer. Said frame is fastened by a suspension 4 on a conveying device 6 indicated by dashes such that the frame 2 can be conveyed to the individual electroplating baths of the electroplating process and be dipped into the respective process fluid.

Figure 2:
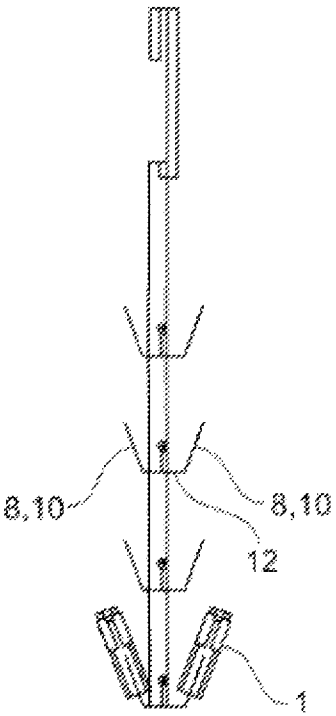
FIG. 2 shows a side view of the frame in accordance with FIG. 1.
Figure 1:
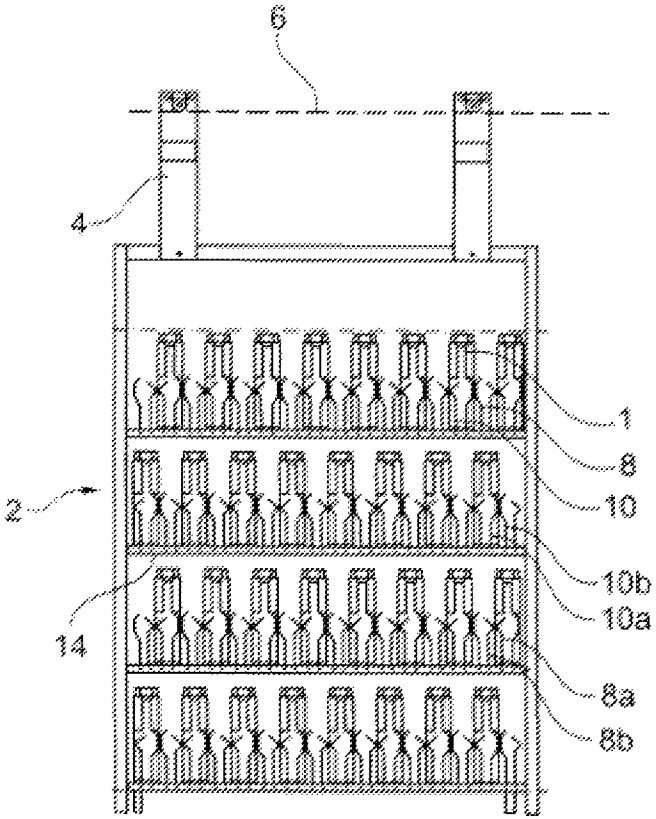
FIG. 1 shows a front view of a frame on which a multiplicity of pole tubes are held when the latter traverse the individual steps of an electroplating process.

As indicated in FIG. 1, each pole tube 1 is held on the frame 2 via clamping legs arranged in paired fashion, each pair 8*a*, 8*b*, 10*a*, 10*b* of clamping legs bearing in clamping fashion against a circumferential wall of the pole tube 1. In the illustrated exemplary embodiment, a total of 64 pairs 8, 10 of clamping legs are provided, and so 64 pole tubes 1 are correspondingly held on the frame 2. As may be gathered, in particular, from the side view in accordance with FIG. 2, four planes of pairs 8, 10 of clamping legs are provided, in particular, with two pairs 8, 10 of clamping legs, which are arranged relative to one another approximately in the shape of a V, being respectively provided in each plane and fastened via a common base 12 on a frame strut 14 running horizontally in the illustration in accordance with FIG. 1. In the illustration in accordance with FIG. 2, the pairs 8, 10 of clamping legs lie one behind another in a fashion perpendicular to the plane of the drawing, the clamping leg profile also running perpendicular to the plane of the drawing such that the pairs 8, 10 of clamping legs appear as straight lines in the side view.

As is customary in electroplating processes, the pole tube 1 forms the anode, the electrical contact being made via the clamping legs 8, 10. The latter are provided with an insulation interrupted in the contacting region so that the current for optimizing the layer structure is fed only along provided regions. The inclination of the pole tubes 1 on the frame 2, and thus the relative positioning of the pole tubes in the electrolyte of the respective electroplating process is selected so as to attain an optimum layer thickness distribution of the layer applied by electroplating, it being possible to improve the coating further by moving, and thus thoroughly mixing the electrolyte via suitable measures such as, for example, Venturi nozzles, agitators etc.

Figure 3B:
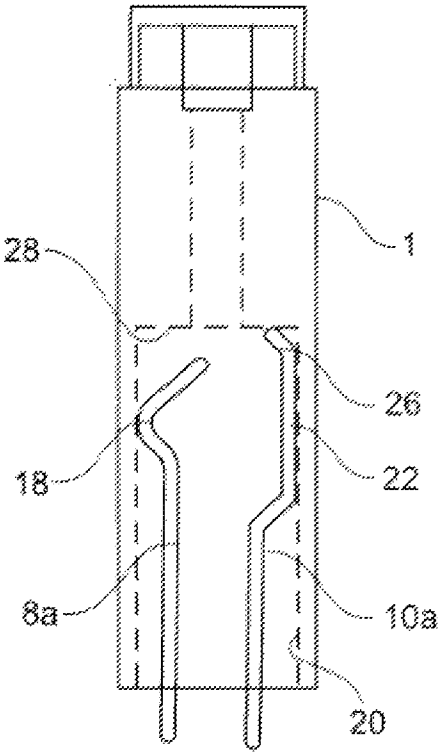
FIGS. 3*a*, 3*b* show detailed illustrations of the frame in accordance with FIGS. 1 and 2.
Figure 3A:
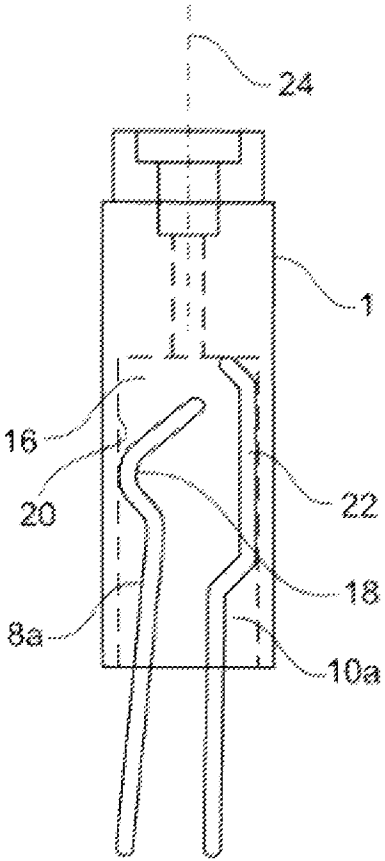

FIGS. 3*a*, 3*b* show individual illustrations of the inner clamping legs 8*a*, 10*a* of the above described pairs 8, 10 of clamping legs, which dip into an accommodating space 16 of the pole tube 1 and bear against the inner circumferential wall 20 thereof such that a mechanical and/or electrical contact are/is made.

Here, the clamping leg 8*a* has a crank 18 which projects in a radial direction and bears in an approximately punctiform fashion against the inner circumferential wall 20. The other clamping leg 10*a* likewise has a holding section 22, which is likewise cambered to the inner circumferential wall 20 in a radial direction, but is embodied with a flat base which bears in an approximately linear fashion against the inner circumferential wall 20 and runs in this case in a fashion approximately parallel to a pole tube axis 24. The two other clamping legs 8*b* and 10*b* (not shown in the illustration in accordance with FIGS. 3*a*, 3*b*) are correspondingly formed and respectively bear against the outer circumferential wall of the pole tube 1 in accordance with the illustration in FIG. 1.

In the illustration in accordance with FIG. 3*a*, a comparatively small pole tube 1 is held via the clamping legs 8*a*, 10*a*. FIG. 3*b* illustrates a pole tube 1 of greater axial length and greater diameter which is likewise held via the clamping legs 8*a*, 10*a*. It is to be seen that when the smaller pole tube 1 (FIG. 3*a*) is clamped, the clamping leg 8*a* with the crank 18 is deflected inwards in a radial direction, although even in this deflected position the crank 18 ensures with its V-shaped leg an approximately punctiform bearing against the inner circumferential wall 20. When the larger pole tube 1 (FIG. 3*b*) is clamped, the clamping leg 8*a* particularly springs outwards in a radial direction and bears against the inner circumferential wall 20 in a clamping fashion. As mentioned, the crank 18 always ensures in this case an approximately punctiform bearing, while the clamping leg 10*a*, which is likewise embodied elastically, bears in a linear fashion against the inner circumferential wall 20 with its holding section 22 in the case of both pole tubes 1. The geometry of the clamping legs 8, 10 thus enables different pole tube sizes to be held on the frame 2.

As may be gathered from FIGS. 3*a*, 3*b*, an end region 26 of the holding section 22 is bent radially inwards and bears against an end wall 28 of the pole piece 1 such that the latter is also supported in an axial direction. The contact surfaces between the pole tube 1 and the clamping legs 8, 10 are minimal, thus enabling electroplating which largely covers the entire surface.

Figure 4:
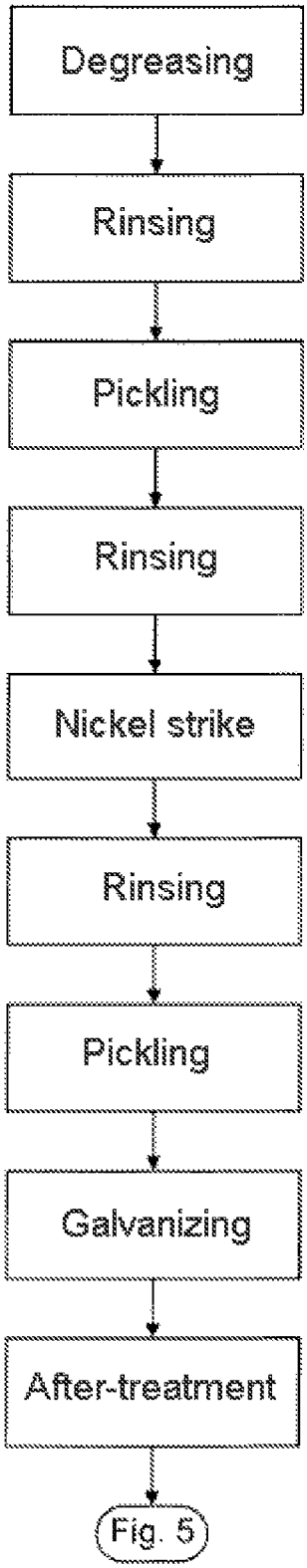
FIG. 4 shows a diagrammatic illustration for explaining the method.
Figure 5:
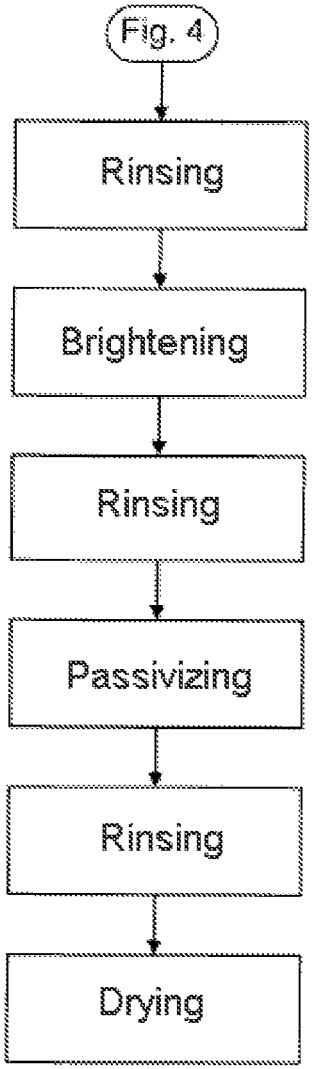
FIG. 5 shows method steps of an aftertreatment in accordance with the method.

The actual electroplating process is explained with the aid of the flowcharts in accordance with FIGS. 4 and 5.

In a first method step, the pole tubes 1 held on the frame 2 are degreased in order to remove layers of oil and fat, it being possible to use aqueous methods, organic solvents or other methods such as, for example, plasma cleaning in a first bath. In order to prevent the liquid used for degreasing from entering the following process step, the degreasing is followed by a rinsing operation, there preferably being multiple or cascade rinsing. Said multiple rinsing has the advantage that the consumption of rinsing water is optimized, and a partial circulation is enabled by concentration and return of rinsing water from the individual steps.

In the case of the particular method illustrated, this rinsing step is followed by pickling or activation by means of oxide layers disturbing the electroplating process being removed in order to produce an active surface. Dilute mineral acids or activating acidic solutions are used for said pickling.

The pickling is followed again by a rinsing step in order to prevent the media used in the pickling from entering the following process step.

After the activation of the surface of the pole tube 1, said surface is dipped into the so-called nickel strike electrolyte, in order to effect a further activation of the surface in conjunction with deposition of a metal precipitate. Such a nickel strike electrolyte contains a proportion of nickel chloride and hydrochloric acid which are dissolved in deionized water. The electroplating bath moreover contains a nickel anode which has a comparatively high degree of purity. For example, the current density can amount to 3 to 5 $A/dm^2$, the duration of treatment in the nickel strike electrolyte amounting, for example, to approximately 3 to 10 minutes, in order to form the abovementioned fine nickel layer on the pole tube 1.

This nickel strike process step is followed by a further rinsing step (multiple rinsing) and renewed pickling in order to prepare for the actual zinc coating. The zinc coating is then performed in a conventional way.

The zinc coating is followed by an aftertreatment which serves to improve the corrosion-resistance and the visual appearance. In accordance with FIG. 5, this aftertreatment can include, for example, a further multistage rinsing and a brightening of the zinc layer. After the brightening, rinsing is performed and can be done in one stage.

In the case of the electroplating process explained, this rinsing operation is then followed by a passivation, preferably a thick layer passivation. Such a thick layer passivation is a surface finish achieved by coating on the basis of chromium-containing compounds, by means of which the corrosion-resistance is further improved. After this passivation, a further multistage rinsing step is performed, and then a drying of the pole tube 1.

According to the above described method, said pole tube 1 is provided with a corrosion-resistant coating which adheres even given unfavorable operating conditions, and is therefore superior to conventional coatings.

A method for coating workpieces which consist of two different metallic materials is described. According to the disclosure, the workpieces are provided in a nickel strike electrolyte with a nickel layer as substrate before the application of a corrosion-resistant layer.

LIST OF REFERENCE NUMERALS

1 Pole tube
2 Frame
4 Suspension
6 Conveying device
8 Pair of clamping legs
10 Pair of clamping legs
12 Base
14 Frame strut
16 Accommodating space
18 Crank
20 Inner circumferential wall
22 Holding section
24 Pole tube axis
26 End region
28 End wall

What is claimed is:

1. A method for coating a workpiece consisting of two different metallic materials that form a material interface in a surface region of the workpiece, the method comprising:

applying a corrosion-resistant layer to the workpiece; and electrolytically applying a metallic adhesive layer to both of the two different metallic materials of the workpiece before the application of the corrosion-resistant layer, wherein the corrosion-resistant layer is a zinc layer, and wherein the two different metallic materials are stainless steel and an unalloyed steel.

2. The method as claimed in claim 1, wherein the adhesive layer is formed by application of a nickel strike electrolyte so that at least the surface region of the workpiece is activated and a nickel layer is formed.

3. The method as claimed in claim 1, wherein the surface region of the workpiece is pickled before the formation of the adhesive layer.

4. The method as claimed in claim 3, wherein a degreasing step is carried out before the pickling.

5. The method as claimed in claim 1, wherein there is a pickling step following the formation of the adhesive layer.

6. The method as claimed in claim 1, wherein the workpiece includes a pole tube that includes at least two pole tube sections, consisting of the two different metallic materials and which are joined along the material interface.

* * * * *